US010253396B2

(12) United States Patent
Schaeffer et al.

(10) Patent No.: US 10,253,396 B2
(45) Date of Patent: Apr. 9, 2019

(54) MODIFIED ARTICLES, COATED ARTICLES, AND MODIFIED ALLOYS

(71) Applicant: GENERAL ELECTRIC COMPANY, Schenectady, NY (US)

(72) Inventors: Jon Conrad Schaeffer, Simpsonville, SC (US); Shan Liu, Central, SC (US); Martin M. Morra, Glenville, NY (US); Michael Douglas Arnett, Simpsonville, SC (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 201 days.

(21) Appl. No.: 15/255,383

(22) Filed: Sep. 2, 2016

(65) Prior Publication Data

US 2018/0066341 A1 Mar. 8, 2018

(51) Int. Cl.

| | |
|---|---|
| ***C22C 19/05*** | (2006.01) |
| ***F01D 5/28*** | (2006.01) |
| ***F01D 9/04*** | (2006.01) |
| ***F01D 25/00*** | (2006.01) |
| ***C22C 19/03*** | (2006.01) |
| ***C22C 30/00*** | (2006.01) |
| ***C22C 45/00*** | (2006.01) |
| ***C22C 45/04*** | (2006.01) |
| *C22F 1/10* | (2006.01) |

(52) U.S. Cl.

CPC ..... *C22C 19/058* (2013.01); *C22C 19/03* (2013.01); *C22C 19/05* (2013.01); *C22C 19/056* (2013.01); *C22C 19/057* (2013.01); *C22C 30/00* (2013.01); *C22C 45/00* (2013.01); *C22C 45/04* (2013.01); *F01D 5/288* (2013.01); *F01D 9/041* (2013.01); *F01D 25/005* (2013.01); *C22F 1/10* (2013.01); *F05D 2240/11* (2013.01); *F05D 2300/175* (2013.01); *F05D 2300/611* (2013.01)

(58) Field of Classification Search

None

See application file for complete search history.

(56) References Cited

U.S. PATENT DOCUMENTS

2010/0254822 A1 10/2010 Hazel et al.
2013/0230405 A1* 9/2013 O'Hara ..... C22C 19/057 416/241 R

FOREIGN PATENT DOCUMENTS

EP 2 128 284 A1 12/2009
WO 2009/032579 A1 3/2009

OTHER PUBLICATIONS

Razumovskii, I.M., et al., "New generation of Ni-based superalloys designed on the basis of first-principles calculations," Materials Science and Engineering A, vol. 497, Issues 1-2, pp. 18-24 (Dec. 15, 2008).

Sato, A., et al., "Oxidation of nickel-based single-crystal superalloys for industrial gas turbine applications," Acta Materialia, vol. 59, Issue 1, pp. 225-240 (Jan. 2011).

Extended European Search Report and Opinion issued in connection with corresponding EP Application No. 17188459.6 dated Feb. 2, 2018.

* cited by examiner

*Primary Examiner* — Jeffrey D Washville

(74) *Attorney, Agent, or Firm* — McNess Wallace & Nurick LLC

(57) ABSTRACT

A modified alloy is disclosed including a base alloy composition and an additive gamma prime antioxidant. The base alloy composition includes a concentration of a gamma prime antioxidant less than an effective concentration of the gamma prime antioxidant. The additive gamma prime antioxidant is intermixed with the base alloy composition to form the modified alloy, preferentially segregating to a gamma prime phase of the modified alloy and increasing the concentration of the gamma prime antioxidant to be at least the effective concentration of the gamma prime antioxidant. The effective concentration imparts reduced oxidation susceptibility of the gamma prime phase. An article is disclosed including the modified alloy. A coated article is disclosed including a coating disposed on a surface of an article having the base alloy composition. The coated article includes a reduced stress accelerated gamma prime oxidation static crack growth susceptibility in comparison with the base alloy composition.

19 Claims, No Drawings

MODIFIED ARTICLES, COATED ARTICLES, AND MODIFIED ALLOYS

FIELD OF THE INVENTION

The present invention is directed to modified articles, coated articles, and modified alloys. More particularly, the present invention is directed to modified articles, coated articles, and modified alloys which are resistant to oxidation-driven crack propagation.

BACKGROUND OF THE INVENTION

Gas turbines operate under extreme conditions, including elevated temperatures under corrosive environments. As the operating temperatures of gas turbines increase to achieve improved efficiency, advanced materials, such as nickel-based superalloys, have been utilized for various turbine components, particularly in the hot gas path. For some alloys and usages, including certain critical hot gas path components, nickel-based superalloys having a single-crystal grain structure have desirable properties, which may include mechanical properties which are superior to other available materials.

However, nickel-based superalloys may be susceptible to stress accelerated gamma prime oxidation (SAGPO) static crack growth. SAGPO static crack growth may occur when a crack tip is internally and preferentially oxidized under operating conditions of a gas turbine. Elevated susceptibility of SAGPO static crack propagation may be present in nickel-based superalloys having a single-crystal grain structure. Indeed, this susceptibility may in certain cases be so severe that turbine components formed from advanced single crystal nickel-based superalloys can fracture under operating conditions. In particular, the single-crystal nickel-based superalloys may have heightened susceptibility to SAGPO static crack growth when the alloy is located in a portion of a turbine component which is subjected to temperatures below the typical operating profile for the alloy, such as, for example, at a temperature of less than about 1,100° F.

BRIEF DESCRIPTION OF THE INVENTION

In an exemplary embodiment, an article includes a modified alloy. The modified alloy includes a base alloy composition and an additive gamma prime antioxidant. The base alloy composition includes a concentration of a gamma prime antioxidant less than an effective concentration of the gamma prime antioxidant. The additive gamma prime antioxidant is intermixed with the base alloy composition to form the modified alloy. The additive gamma prime antioxidant increases the concentration of the gamma prime antioxidant to be at least the effective concentration of the gamma prime antioxidant. The gamma prime antioxidant preferentially segregates to a gamma prime phase of the modified alloy. The effective concentration is a concentration which imparts a property in the modified alloy of reduced oxidation susceptibility of the gamma prime phase in comparison with a base alloy consisting of the base alloy composition.

In another exemplary embodiment, a coated article includes an article including a base alloy composition, and a coating disposed on a surface of the article. The coating includes an oxidation-resistant material, wherein the oxidation-resistant material is more resistant to oxidation than the base alloy composition. The coated article includes a property of reduced stress accelerated gamma prime oxidation static crack growth susceptibility in comparison with the base alloy composition.

In another exemplary embodiment, a modified alloy includes a base alloy composition and an additive gamma prime antioxidant. The base alloy composition includes a concentration of a gamma prime antioxidant less than an effective concentration of the gamma prime antioxidant. The additive gamma prime antioxidant is intermixed with the base alloy composition to form the modified alloy. The additive gamma prime antioxidant increases the concentration of the gamma prime antioxidant to be at least the effective concentration of the gamma prime antioxidant. The gamma prime antioxidant preferentially segregates to a gamma prime phase of the modified alloy. The effective concentration is a concentration which imparts a property in the modified alloy of reduced oxidation susceptibility of the gamma prime phase in comparison with a base alloy consisting of the base alloy composition.

Other features and advantages of the present invention will be apparent from the following more detailed description of the preferred embodiment, taken in conjunction with the accompanying drawings, which illustrate, by way of example, the principles of the invention.

DETAILED DESCRIPTION OF THE INVENTION

Provided are exemplary modified articles, coated articles, and modified alloys. Embodiments of the present disclosure, in comparison to articles, coated articles, and alloys not utilizing one or more features disclosed herein, reduce or eliminate SAGPO static crack growth, decrease costs, improve component service lifetime, improve durability, or a combination thereof.

In one embodiment, a modified alloy includes a base alloy composition and an additive gamma prime antioxidant. The base alloy composition is free of gamma prime antioxidant or includes a concentration of the gamma prime antioxidant less than an effective concentration of the gamma prime antioxidant. The additive gamma prime antioxidant is intermixed with the base alloy composition to form the modified alloy, and the gamma prime antioxidant preferentially segregates to a gamma prime phase of the modified alloy.

The additive gamma prime antioxidant increases the concentration of the gamma prime antioxidant to be at least the effective concentration of the gamma prime antioxidant. As used herein, "effective concentration" refers to a concentration which imparts a property in the modified alloy of reduced oxidation susceptibility of the gamma prime phase in comparison with a base alloy consisting of the base alloy composition. As used herein, "reduced oxidation susceptibility" includes complete elimination of oxidation susceptibility. Without being bound by theory, it is believed that the gamma prime antioxidant may form an inert outwardly growing oxide layer, which, in sufficient concentration, may exhibit a passivation effect and reduce or eliminate oxygen ingress into the gamma prime phase of the modified alloy.

As used herein, "gamma prime antioxidant" refers to a material which is preferentially or sacrificially oxidized in comparison to the gamma prime phase of the base alloy composition under the operating conditions to which the gamma prime phase of the base alloy composition is subjected. The gamma prime antioxidant may be any suitable material, including, but not limited to, titanium, hafnium, yttrium, lanthanum, cerium, and combinations thereof.

The base alloy composition may be any suitable material composition, including, but not limited to, at least one of a nickel-based superalloy, a nickel-based superalloy including at least 50 vol. % gamma prime phase, CMSX 10, TMS 75, TMS 82, René N2, René N5, René N6, René N500, René N515, and TWA 1484.

As used herein, "CMSX 10" refers to an alloy including a composition, by weight, of about 2.65% chromium, about 7% cobalt, about 5.8% aluminum, about 0.8% titanium, about 6.4% tungsten, about 0.6% molybdenum, about 5.5% rhenium, about 7.5% tantalum, about 0.4% niobium, about 0.06% hafnium, and a balance of nickel.

As used herein, "TMS 75" refers to an alloy including a composition, by weight, of about 3.5% chromium, about 12.5% cobalt, about 13.7% aluminum, about 2% tungsten, about 1.2% molybdenum, about 1.6% rhenium, about 2% tantalum, about 0.04% hafnium, and a balance of nickel.

As used herein, "TMS 82" refers to an alloy including a composition, by weight, of about 5.8% chromium, about 8.2% cobalt, about 12.2% aluminum, about 0.63% titanium, about 2.9% tungsten, about 1.2% molybdenum, about 0.8% rhenium, about 2.1% tantalum, about 0.04% hafnium, and a balance of nickel.

As used herein, "René N2" refers to an alloy including a composition, by weight, of about 7.5% cobalt, about 13% chromium, about 6.6% aluminum, about 5% tantalum, about 3.8% tungsten, about 1.6% rhenium, about 0.15% hafnium, and a balance of nickel.

As used herein, "René N5" refers to an alloy including a composition, by weight, of about 7.5% cobalt, about 7.0% chromium, about 6.5% tantalum, about 6.2% aluminum, about 5.0% tungsten, about 3.0% rhenium, about 1.5% molybdenum, about 0.15% hafnium, and a balance of nickel.

As used herein, "René N6" refers to an alloy including a composition, by weight, of about 12.5% cobalt, about 4.2% chromium, about 7.2% tantalum, about 5.75% aluminum, about 6% tungsten, about 5.4% rhenium, about 1.4% molybdenum, about 0.15% hafnium, and a balance of nickel.

As used herein, "René N500" refers to an alloy including a composition, by weight, of about 7.5% cobalt, about 0.2% iron, about 6% chromium, about 6.25% aluminum, about 6.5% tantalum, about 6.25% tungsten, about 1.5% molybdenum, about 0.15% hafnium, and a balance of nickel.

As used herein, "René N515" refers to an alloy including a composition, by weight, of about 7.5% cobalt, about 0.2% iron, about 6% chromium, about 6.25% aluminum, about 6.5% tantalum, about 6.25% tungsten, about 2% molybdenum, about 0.1% niobium, about 1.5% rhenium, about 0.6% hafnium, and a balance of nickel.

As used herein, "TWA 1484" refers to an alloy including a composition, by weight, of about 10% cobalt, about 5% chromium, about 5.6% aluminum, about 8.7% tantalum, about 6% tungsten, about 3% rhenium, about 2% molybdenum, about 0.1% hafnium, and a balance of nickel.

The modified alloy may include any suitable microstructure, including, but not limited to a single crystal microstructure, a columnar grain microstructure, or a combination thereof. In one embodiment, the modified alloy includes a property of reduced SAGPO static crack growth susceptibility in comparison with a base alloy consisting of the base alloy composition.

In one embodiment, the effective concentration of the gamma prime antioxidant includes a maximum concentration of the gamma prime antioxidant, wherein the maximum concentration is less than a concentration of the gamma prime antioxidant which would materially and negatively impact at least one of an environmental, a physical and a mechanical property of the base alloy composition. As used herein, a material negative impact is any adverse alteration of a property of the base alloy composition which would place the modified alloy composition outside of the tolerances required by the operational conditions to which the modified alloy is subjected.

Considered with respect to the modified alloy as a whole, the effective concentration of the gamma prime antioxidant may be, by weight, about 0.05% to about 2%, alternatively about 0.1% to about 1%, alternatively about 0.1% to about 2%, alternatively about 0.25% to about 0.75%, alternatively about 0.25% to about 2%, alternatively at least about 0.05%, alternatively at least about 0.1%, alternatively at least about 0.5%. Considered with respect to the gamma prime phase of the modified alloy alone, the effective concentration of the gamma prime antioxidant may be, by weight, about 0.5% to about 10%, alternatively about 0.5% to about 2%, alternatively about 1% to about 2%, alternatively about 1% to about 5%, alternatively about 1% to about 10%, alternatively about 2% to about 4%, alternatively about 2% to about 10%, alternatively at least about 0.5%, alternatively at least about 1%, alternatively at least about 1.5%, alternatively at least about 2%.

In one embodiment, an article includes the modified alloy. The article may be a turbine component or a portion of a turbine component. The turbine component may be any suitable turbine component, including, but not limited to, a bucket (blade), a nozzle (vane), a shroud, or a combination thereof. The portion of the turbine component may be any suitable portion, including, but not limited to, a portion subjected to reduced temperatures relative to a second portion of the turbine component, an internal cavity, a shank, or a combination thereof.

In one embodiment, the portion of the turbine component includes an operating temperature of less than about 1,500° F., alternatively less than about 1,300° F., alternatively less than about 1,100° F., alternatively less than about 900° F., alternatively between about 800° F. and about 1,300° F., alternatively between about 900° F. and about 1,100° F. In a further embodiment, a second portion of the turbine component includes an operating temperature of at least about 1,550° F., alternatively at least about 1,600° F., alternatively at least about 1,700° F., alternatively between about 1,550° F. and about 2,500° F., alternatively between about 1,600° F. and about 2,000° F.

In another embodiment, a coated article includes a coating having an oxidation-resistant material disposed on a surface of an article. The article may include the base alloy composition or the modified alloy. The oxidation resistant material may be any suitable oxidation-resistant material wherein the oxidation-resistant material is more resistant to oxidation than the base alloy composition, including, but not limited to, an oxidation-resistant material including, by weight, a least about 45% nickel, alternatively at least about 50% nickel, alternatively at least about 60% nickel, and up to about 30% aluminum, alternatively between about 10% aluminum to about 30% aluminum, alternatively between about 20% aluminum to about 30% aluminum. The oxidation-resistant material may further include at least one of chromium and cobalt. In one embodiment, the oxidation-resistant material includes a balance of chromium and cobalt.

The coating may have any suitable thickness, including, but not limited to, a thickness of up to about 2 mils, alternatively between about 0.5 mils to about 2 mils. The coating may be disposed on the entire surface of the article or the coating may be disposed on a portion of the surface which is less than the entire surface of the article, such as, but not limited to, a surface which is prone to oxidation-induced cracking. The portion of the surface upon which the coating is applied may include a single discrete region or a plurality of separated and discrete regions of the entire surface of the article.

The coating may be subjected to any suitable heat treatment to develop an inherently stable zone between the coating and the article. In one embodiment, the inherently stable zone, which may also be referred to as an interdiffusion zone, includes thermal and mechanical properties which are intermediate between the comparable properties of the coating and the base alloy, or between the comparable properties of the coating and the modified alloy. Without being bound by theory, it is believed that having such intermediate properties decreases or eliminates spalling of the coating.

Without being bound by theory, it is believed that the coating having the oxidation-resistant material may prevent ingression of oxygen into the matrix of the base alloy composition or the modified alloy, altering the stress state in the immediate proximity of the coated surface such that the gamma prime phase of the base alloy composition or the modified alloy maintains its particulate form. In a further embodiment, the coating consists of the oxidation-resistant material. Without the coating, gamma prime phase present in the base alloy or the modified alloy may transition to a rafted form in which each raft is perpendicular to the local tensile. Without being bound by theory, it is believed that having the gamma prime phase in a particulate form may have superior mechanical properties and be more resistive SAGPO static crack growth as compared to the rafted form.

While the invention has been described with reference to a preferred embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. An article comprising a modified alloy, the modified alloy including:

a base alloy composition comprising: i) a nickel-based superalloy and ii) a concentration of a gamma prime antioxidant less than an effective concentration of the gamma prime antioxidant; and additive gamma prime antioxidant intermixed with the base alloy composition to form the modified alloy, the additive gamma prime antioxidant increasing the concentration of the gamma prime antioxidant to be at least the effective concentration of the gamma prime antioxidant, the gamma prime antioxidant preferentially segregating to a gamma prime phase of the modified alloy, wherein the effective concentration of the gamma prime antioxidant is a concentration which imparts a property in the modified alloy of reduced oxidation susceptibility of the gamma prime phase in comparison with a base alloy consisting of the base alloy composition.

2. The article of claim 1, wherein the article is a portion of a turbine component.

3. The article of claim 2, wherein the portion of the turbine component has an operating temperature of less than about 1,100° F.

4. The article of claim 2, wherein the turbine component is selected from the group consisting of a bucket (blade), a nozzle (vane), a shroud, and combinations thereof.

5. The article of claim 1, wherein the modified alloy includes a single crystal microstructure.

6. The article of claim 1, wherein the modified alloy includes a columnar grain microstructure.

7. The article of claim 1, wherein the effective concentration of the gamma prime antioxidant in the modified alloy is from about 0.1% to about 1%, by weight.

8. The article of claim 1, wherein the effective concentration of the gamma prime antioxidant in the gamma prime phase of the modified alloy is from about 1% to about 5%, by weight.

9. The article of claim 1, wherein the base alloy composition is selected from the group consisting of at least one of a nickel-based superalloy, a nickel-based superalloy including at least 50 vol. % gamma prime phase, CMSX 10, TMS 75, TMS 82, René N2, René N5, René N6, René N500, René N515, and TWA 1484.

10. The article of claim 1, wherein the gamma prime antioxidant is selected from the group consisting of titanium, hafnium, yttrium, lanthanum, cerium, and combinations thereof.

11. The article of claim 10, wherein the gamma prime antioxidant is selected from the group consisting of lanthanum, cerium, and combinations thereof.

12. The article of claim 1, wherein the modified alloy includes a property of reduced stress accelerated gamma prime oxidation static crack growth susceptibility in comparison with the base alloy consisting of the base alloy composition.

13. The article of claim 1, wherein the article includes a coating having an oxidation-resistant material disposed on a surface of the article, wherein the oxidation-resistant material is more resistant to oxidation than the base alloy composition.

14. The article of claim 13, wherein the oxidation-resistant material includes, by weight, up to about 30% aluminum.

15. A modified alloy, comprising:

a base alloy composition comprising: i) a nickel-based superalloy and ii) a concentration of a gamma prime antioxidant less than an effective concentration of the gamma prime antioxidant; and additive gamma prime antioxidant intermixed with the base alloy composition to form the modified alloy, the additive gamma prime antioxidant increasing the concentration of the gamma prime antioxidant to be at least the effective concentration of the gamma prime antioxidant, the gamma prime antioxidant preferentially segregating to a gamma prime phase of the modified alloy, wherein the effective concentration of the gamma prime antioxidant is a concentration which imparts a property in the modified alloy of reduced oxidation susceptibility of the gamma prime phase in comparison with a base alloy consisting of the base alloy composition.

16. The modified alloy claim 15, wherein the oxidation-resistant material includes, by weight, at least about 50% nickel and up to about 30% aluminum.

17. The modified alloy of claim 16, wherein the oxidation-resistant material further includes a balance of chromium and cobalt.

18. The modified alloy claim 15, wherein the surface is a portion of an entire surface of the article less than the entire surface of the article.

19. The modified alloy claim 15, wherein the base alloy composition is selected from the group consisting of at least one of a nickel-based superalloy, a nickel-based superalloy including at least 50 vol. % gamma prime phase, CMSX 10, TMS 75, TMS 82, René N2, René N5, René N6, René N500, René N515, and TWA 1484.

* * * * *